US005970928A

United States Patent [19]

Smietanski et al.

[11] Patent Number: 5,970,928

[45] Date of Patent: Oct. 26, 1999

[54] SELF RESTRICTING ENGINE COOLING SYSTEM DEAERATION LINE

[75] Inventors: Richard A. Smietanski, Lockport; David L. Rowland, Burr Ridge, both of Ill.

[73] Assignee: Navistar International Transportation Corp, Chicago, Ill.

[21] Appl. No.: 09/181,401

[22] Filed: Oct. 28, 1998

[51] Int. Cl.[6] ..... F01P 3/22

[52] U.S. Cl. ..... 123/41.54

[58] Field of Search ..... 123/41.54

[56] References Cited

U.S. PATENT DOCUMENTS

| | | | |
|---|---|---|---|
| Re. 32,434 | 6/1987 | Avrea | 360/44 |
| 4,064,848 | 12/1977 | Pabst et al. . | |
| 4,168,192 | 9/1979 | Nyberg | 156/86 |
| 4,352,342 | 10/1982 | Cser et al. . | |
| 4,473,037 | 9/1984 | Michassouridis . | |
| 4,785,874 | 11/1988 | Avrea . | |
| 5,111,776 | 5/1992 | Matsushiro et al. . | |
| 5,143,122 | 9/1992 | Adkins | 138/109 |
| 5,257,661 | 11/1993 | Frech et al. | 165/104.32 |
| 5,275,133 | 1/1994 | Sasaki et al. | 123/41.31 |
| 5,340,167 | 8/1994 | Morse | 285/243 |
| 5,385,123 | 1/1995 | Evans | 123/41.21 |
| 5,566,988 | 10/1996 | Johnston et al. | 285/93 |
| 5,666,911 | 9/1997 | Gohl et al. | 123/41.54 |

*Primary Examiner*—Noah P. Kamen
*Assistant Examiner*—Hai Huynh
*Attorney, Agent, or Firm*—Dennis K. Sullivan; Jeffrey P. Calfa

[57] ABSTRACT

An internal combustion engine includes a spaced apart surge tank, the surge tank being an integral component of a pressurized liquid engine cooling system. A first conduit fluidly couples the surge tank to a component of the pressurized liquid engine cooling system. The conduit has an internal fluid passageway defined therein. The conduit is heat responsive, an application of heat to the conduit acting to effect a contraction of the fluid passageway. Further, a method of controlling fluid flow in a conduit connecting the surge tank to a component of a pressurized liquid engine cooling system, comprises the steps of:

forming the conduit of a heat responsive material;

flowing a fluid through the conduit;

running the engine to an elevated fluid temperature; and contracting the conduit fluid passageway responsive to the heating of the conduit caused by the fluid flow therein.

15 Claims, 3 Drawing Sheets

SELF RESTRICTING ENGINE COOLING SYSTEM DEAERATION LINE

TECHNICAL FIELD

The present invention related to internal combustion engines. More particularly, the present invention relates to the pressurized fluid cooling system of such engines.

BACKGROUND OF THE INVENTION

The cooling systems of liquid-cooled, internal combustion engines in vehicles are usually closed positive-pressure systems and include as a component a surge tank. The surge tank fulfills several important tasks: it must compensate for the volume changes resulting from the temperature changes of the cooling liquid, it must collect the air present in the liquid system, and it must prevent excessive depression or cavitation in front of the coolant pump. The surge tanks are typically installed in parallel with the main liquid circuit between the radiator and cooling passages formed in the engine block and cylinder head. The surge tank is so connected that the deaeration line, starting from the highest geodetic point of the cooling system, discharges generally upward into the surge tank and the fill line from the surge tank is connected proximate the pump intake of the liquid coolant pump.

The engine is mounted in a vehicle chassis. The cooling system radiator is mounted in proximity to the engine and at relatively the same level. A cooling system surge tank is mounted high on the firewall of the vehicle, above the level of the engine and radiator. A vent or deaeration line is connected from a point on the engine just below the coolant thermostat up to the bottom of the surge tank. A second larger conduit is connected also from the bottom of the surge tank to the engine near the water pump inlet. The purpose of the surge tank, which is part of the pressurized cooling system is:

(1) To allow the operator to check the level of coolant in the system.

(2) To allow expansion and contraction of the coolant, while always maintaining the coolant level in the radiator and engine at 100% full.

(3) To allow, by means of the deaeration line described above, the venting of any entrapped air in the engine and radiator as the system is initially filled with coolant. Should any air be drawn in for any reason after the initial fill, the air will find its way to the high point of the engine and be expelled through the deaeration line to the surge tank.

It should be noted that the deaeration line always remains open. It is not throttled by the cooling system thermostat or any other regulating device. Therefore, there is always the possibility of coolant flow from the engine through the deaeration line to the surge tank. This depletion of the coolant from the engine is returned via the second connection from the surge tank (the fill line) to the area of the water pump inlet on the engine.

While this constant flow to the surge tank and back to the engine serves to purge any entrapped air to the surge tank, it is not beneficial to the performance of the heat exchange function of the cooling system. As compared to the cooling system radiator, the surge tank serves as a poor heat transfer component. Ideally, the deaeration line would be sized as small in diameter as might be possible, still allowing air to escape upwards to the surge tank, but small enough to greatly restrict the flow of coolant to the surge tank in normal operation. The ideal is to purge air from the coolant, but to greatly limit liquid flow to the surge tank so that as much of the total volume of coolant is available for the radiator to efficiently perform the coolant cooling function.

Typically, the deaeration line is sized to provide an inside diameter that will allow the air to be evacuated from the engine and radiator when the pressurized fast fill system of pumping coolant into the system at the original build site (factory) is incorporated. The fast fill system requires substantially greater flow rates through the deaeration line than is required during normal engine operation. This fast fill system is used to reduce coolant fill time and the labor associated with it. Once in normal service, a vehicle would not again be subjected to this fast fill coolant method, even at a dealership. Therefore, the deaeration line which was sized to allow a great volume of air to be expelled during fast coolant fill, is not called on again to perform its function at such a high volumetric rate for the remainder of the vehicle life. In normal operation, any mass flow of coolant through the deaeration line is detrimental to the total cooling system performance. Accordingly, there is a need in the industry to be able to use the fast fill system at engine build and, in normal engine operation, to purge air from the coolant, but to greatly limit liquid flow to the surge tank during normal engine operation so that as much of the total volume of coolant as possible is available for the radiator to efficiently perform the coolant cooling function.

SUMMARY OF THE INVENTION

The present invention substantially meets the aforementioned needs of the industry. The present invention has the following advantages:

(1) After initial build of the vehicle, when the coolant is installed by the fast fill method the deaeration line is of a size that easily allows the expulsion of large amounts of air. The line is initially of the same diameter as is currently employed.

(2) Once the engine is started and begins to generate heat, the coolant warms up, and the heat shrink material used for the deaeration line causes the deaeration line to reduce its inside diameter (decreasing the cross-sectional area of the fluid passageway) and thereby to reduce the coolant flow through the deaeration line, causing an increase in the performance of the cooling system.

(3) No components other than the deaeration line conduit need be changed. All connections made at the engine and surge tank remain the same. No machining of the engine components and/or surge tank is affected.

The internal combustion engine of the present invention includes an engine and a spaced apart surge tank, the surge tank being an integral component of a pressurized liquid engine cooling system. A first conduit fluidly couples the surge tank to a component of the pressurized liquid engine cooling system. The conduit has an internal fluid passageway defined therein. The conduit is heat responsive, an application of heat to the conduit acting to effect a contraction of the fluid passageway. The present invention is also a method of controlling fluid flow in a conduit connecting the surge tank to a component of a pressurized liquid engine cooling system, comprising the steps of:

forming the conduit of a heat responsive material;

flowing a fluid through the conduit;

running the engine to an elevated fluid temperature; and contracting the conduit fluid passageway responsive to the heating of the conduit caused by the fluid flow therein.

DETAILED DESCRIPTION

Figure 1:
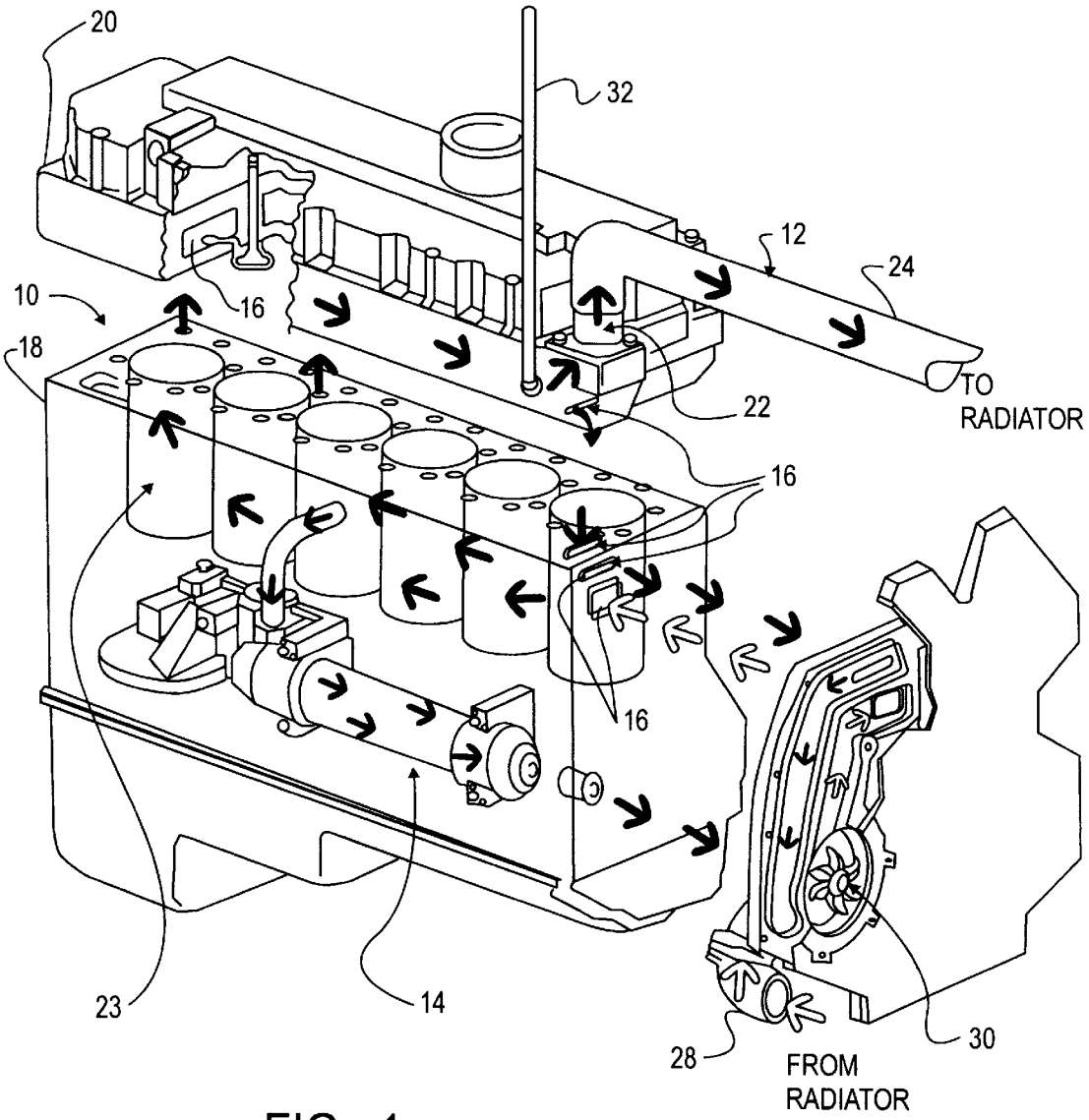
FIG. 1 is an exploded, perspective view of the cooling system of a liquid-cooled combustion engine, including the deaeration line of the present invention.
Figure 2:
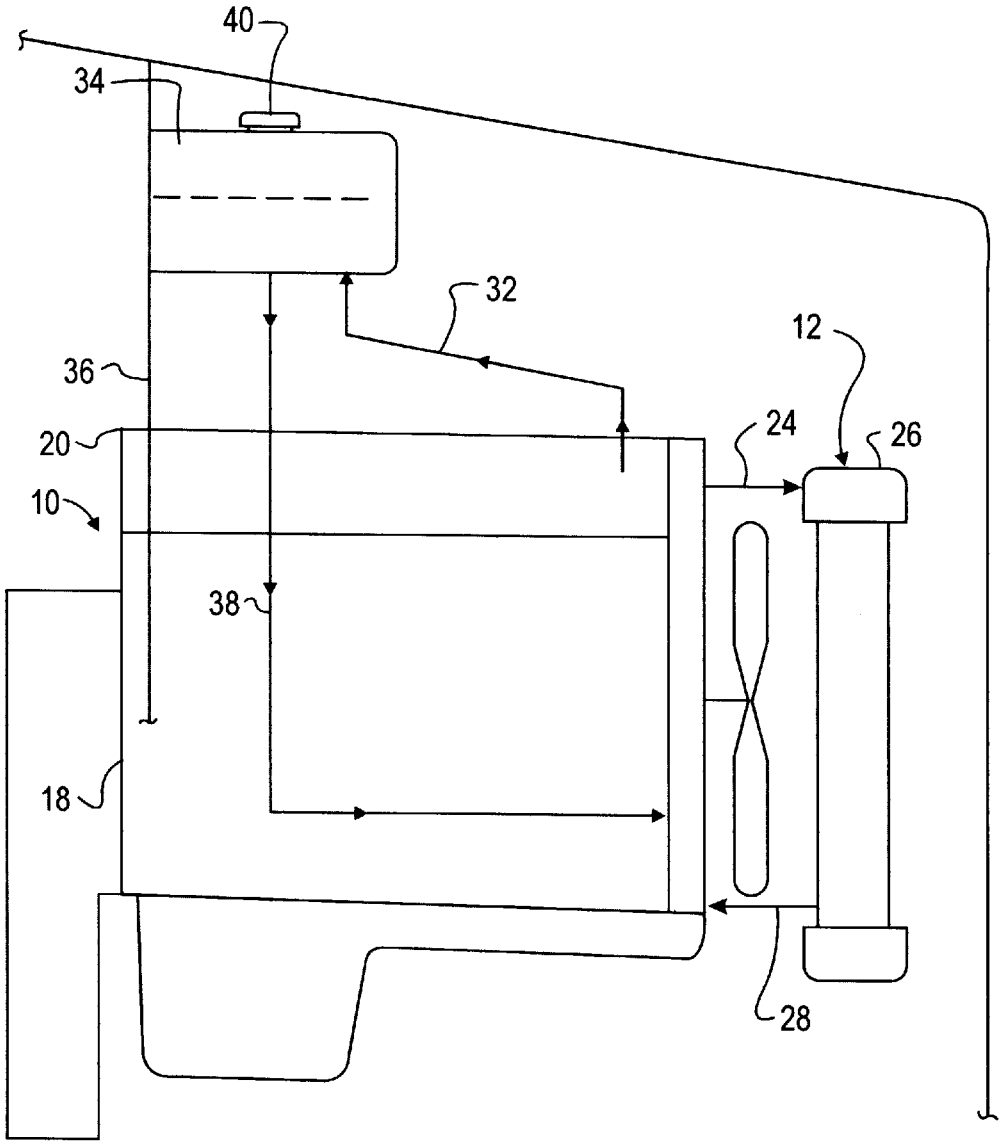
FIG. 2 is a schematic view of the cooling system of a liquid-cooled combustion engine, including the deaeration line of the present invention.

FIGS. 1 and 2 show the cooling circuit of a liquid cooled combustion engine. The main circuit of the cooling system 12 of the combustion engine 10 is formed by the following components. An oil cooler 14 is connected to the plurality of coolant passageways 16 defined in the engine block 18 and the head 20 of the engine 10, an oil cooler for cooling the oil of the transmission (not shown) and a thermostat valve 22. The coolant passageways 16 are spaced in the engine block 18 to effect cooling of the cylinder sleeves 23. The thermostat valve 22 is connected via conduit 24 with the radiator 26 (FIG. 2). The discharge line 28 of the radiator 26 is fluidly connected to the water pump 30. The pressure side of the water pump 30 is connected via the plurality of coolant passageways 16 with the oil cooler 14. The oil cooler 14 cools the lubricating oil of the engine 10.

The deaeration line 32 (or vent line) is connected to the surge tank 34 (FIG. 2.). The surge tank 34 is preferably mounted to the vehicle firewall 36 at a greater height than any other component of the cooling system 12 so that entrained air in the coolant escapes to the surge tank 34 through the deaeration line 32. Coolant in the surge tank 34 flows back to the engine through the fill line 38. The surge tank has a removable cap 40. Removing the cap 40 permits visual inspection of the coolant level in the surge tank 34 and replacement of coolant in the cooling system 12.

The present invention replaces the current deaeration line 32 (vent line) with a similar size conduit 32 made of heat shrinkable polymer material. The heat shrinkable material may be similar to that which is currently in widespread use for electrical harnesses and systems. The material selected is suitable for continued long term use in an underhood environment.

Figure 3A:
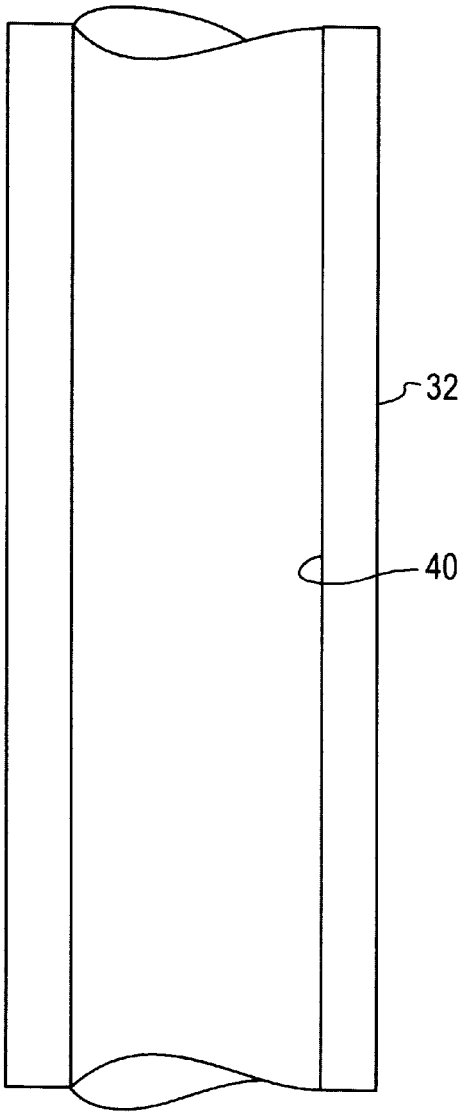
FIG. 3*a* is an elevational view of a portion of the deaeration line of the present invention prior to contraction.

In operation, after initial build of the vehicle, when essentially room temperature coolant is installed in the cooling system 12 by the fast fill method employed, the deaeration line 32 is of a size that easily allows the expulsion of large amounts of air from the cooling system when the coolant is forced into the cooling system under pressure. Referring to FIG. 3*a*, the line 32 has an internal fluid passageway 40 that is initially of the same diameter as is currently employed.

Figure 3B:
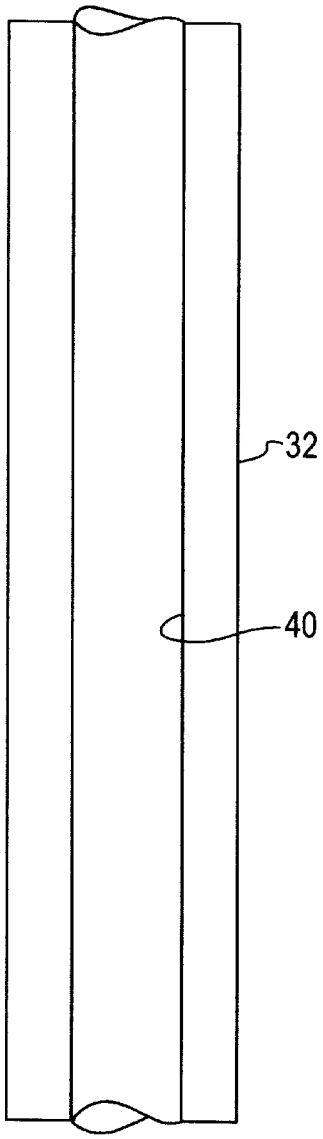
FIG. 3*b* is an elevational view of a portion of the deaeration line of the present invention after contraction, due to the application of heat.

Referring to FIG. 3*b*, once the engine 10 is started and begins to generate heat, the coolant warms up, and the heat shrink material used for the deaeration line 32 causes the deaeration line 32 to reduce the diameter and cross-sectional area of the internal fluid passageway 40, producing a cross-sectional contraction of the internal fluid passageway 40 and thereby to restrict the coolant flow through the deaeration line 32. The restriction thereby increases the performance of the cooling system 12 by minimizing flow through the surge tank 34. In the preferred embodiment, this shrinking process of the deaeration line 32 is essentially irreversible. The reduction in the diameter of the internal fluid passageway 40 preferably occurs at a temperature of between 100 and 250 degrees F.

Although a certain specific embodiment of the present invention has been shown and described, it is obvious that many modifications and variations thereof are possible in light of the teachings. It is to be understood therefore that within the scope of the appended claims, the invention may be practiced otherwise than as specifically described herein.

What is claimed is:

1. An internal combustion engine including a pressurized liquid engine cooling system, the cooling system having a spaced apart surge tank, comprising:

a first conduit fluidly coupling the surge tank to a first component of the pressurized liquid engine cooling system, the conduit having an internal fluid passageway defined therein, the conduit being heat responsive, an application of heat to the conduit acting to effect a cross-sectional contraction of the fluid passageway.

2. The internal combustion engine of claim 1 wherein the contraction of the fluid passageway is a substantially irreversible, one-time event.

3. The internal combustion engine of claim 1 wherein the contractive response of the conduit is effected by the passage of engine-heated fluid through the internal fluid passageway of the conduit.

4. The internal combustion engine of claim 3 wherein the contractive response of the conduit is effected by the passage of engine heated fluid through the internal fluid passageway thereof, the fluid being at a temperature of between 100 and 250 degrees F.

5. A method of controlling fluid flow in a conduit connecting a surge tank to a component of a pressurized liquid engine cooling system, comprising the steps of;

forming the conduit of a heat responsive material;

defining a fluid passageway having a selected cross-sectional area in the conduit;

flowing a fluid through the conduit, the fluid being at an elevated temperature;

heating the conduit; and cross-sectionally contracting the conduit fluid passageway, thereby substantially reducing the flow capacity of the fluid passageway responsive to the heating of the conduit.

6. The method of claim 5 wherein the contraction of the fluid passageway is substantially irreversible.

7. The method of claim 5 wherein the fluid is at a temperature of between 100 and 250 degrees F.

8. A conduit for fluidly coupling a first component of a pressurized liquid internal combustion engine cooling system to a second component of a pressurized liquid internal combustion engine cooling system by a fluid passageway defined in the conduit, comprising;

the conduit being formed of a heat responsive material, the conduit fluid passageway having a selected cross-sectional dimension, a fluid flowing through the conduit fluid passageway at an elevated temperature acting to cross-sectionally contract the conduit fluid passageway responsive to the heating of the conduit caused by the fluid flow therein.

9. The conduit of claim 8 wherein the contraction of the fluid passageway is substantially irreversible.

10. The conduit of claim 8 wherein the contractive response of the conduit is effected by the passage of engine-heated fluid through the conduit fluid passageway.

11. The internal combustion engine of claim 10 wherein the contractive response of the conduit is effected by the passage of engine heated fluid through the fluid passageway thereof, the fluid being at a temperature of between 100 and 250 degrees F.

12. A conduit for use with an internal combustion engine, the internal combustion engine including a pressurized liquid engine cooling system for circulating a volume of coolant therein, the cooling system having a spaced apart surge tank, comprising:

a first conduit fluidly coupling the surge tank to a first component of the pressurized liquid engine cooling system, the conduit having an internal fluid passageway defined therein, the conduit internal fluid passageway having a sufficient volumetric flow rate to expel a great volume of air from the engine during an initial fast fill of coolant into the engine, the conduit thereafter being shrinkable to substantially reduce the conduit volumetric flow rate to permit deaeration of coolant during normal engine operation while restricting the mass flow of the coolant in the conduit.

13. The conduit of claim 12 wherein the conduit is heat responsive, a first application of heat to the conduit acting to effect a substantially irreversible cross-sectional contraction of the fluid passageway.

14. The conduit of claim 13 wherein the contractive response of the conduit is effected by the passage of engine-heated fluid through the internal fluid passageway of the conduit.

15. The internal combustion engine of claim 14 wherein the contractive response of the conduit is effected by the passage of engine heated fluid through the internal fluid passageway of the conduit, the fluid being at a temperature of between 100 and 250 degrees F.

* * * * *